US005346634A

United States Patent [19]

Sawazaki et al.

[11] Patent Number: 5,346,634

[45] Date of Patent: Sep. 13, 1994

[54] LUBRICANT COMPOSITION FOR HOT PLASTIC WORKING

[75] Inventors: Yoshihiko Sawazaki; Yasuo Okumura; Nobuichi Arai, all of Tokyo, Japan

[73] Assignee: Nihon Parkerizing Co., Ltd., Tokyo, Japan

[21] Appl. No.: 17,394

[22] Filed: Feb. 12, 1993

[51] Int. Cl.[5] ..... C10M 103/02

[52] U.S. Cl. ..... 252/30; 252/18

[58] Field of Search ..... 252/30, 18

[56] References Cited

U.S. PATENT DOCUMENTS

| | | | |
|---|---|---|---|
| 2,901,380 | 8/1959 | Crump | 428/142 |
| 3,021,594 | 2/1962 | Clatot et al. | 29/424 |
| 3,278,429 | 10/1966 | Agnew et al. | 252/28 |
| 3,379,642 | 4/1968 | Nielsen et al. | 252/30 |
| 3,931,020 | 1/1976 | Burgess et al. | 252/30 |
| 4,050,932 | 9/1977 | Lemmer | 419/28 |
| 4,131,552 | 12/1978 | Marcantonio | 252/29 |
| 4,270,348 | 6/1981 | Winberg | 60/323 |

FOREIGN PATENT DOCUMENTS

| | | |
|---|---|---|
| 0372559 | 6/1990 | European Pat. Off. . |
| 0403306 | 12/1990 | European Pat. Off. . |
| 64-16894 | 1/1989 | Japan . |
| 3-259998 | 11/1991 | Japan . |
| 57-159893 | 10/1992 | Japan . |

*Primary Examiner*—John Niebling
*Assistant Examiner*—Edna Wong
*Attorney, Agent, or Firm*—Cushman, Darby & Cushman

[57] ABSTRACT

A lubricant composition useful for hot plastic working of metal material comprises 100 parts by weight of graphite particles and 2 to 100 parts by weight of particles of at least one metal oxide selected from oxides of Sn, Pb, Zn, Ca, Cu and Al and having an average size of 0.01 to 20.0 μm.

8 Claims, No Drawings

LUBRICANT COMPOSITION FOR HOT PLASTIC WORKING

BACKGROUND OF THE INVENTION

1. Field of the Invention

The present invention relates to a lubricant composition for hot plastic working containing graphite. More particularly, the present invention relates to a graphite-containing lubricant composition for hot plastic working, having an excellent inhibiting effect against carburizing phenomenon, which often occurs when the graphite-containing lubricant is applied to a metal material.

2. Description of Related Art

When a metal material is subjected to a hot plastic working, for example, hot rolling, extrusion or forging, a lubricant is used to decrease friction, for example between a die for forging and the metal material to be worked, to prevent galling or seizing and to render the plastic working easy.

Generally, the lubricant is classified into two groups, namely a graphite-type lubricant and a nongraphite-type lubricant.

The graphite-type lubricant comprises graphite as a principal component. The nongraphite-type lubricant comprises, as a principal component, boron nitride, silicate or calcium carbonate. Each of the graphite type and nongraphite type lubricants contains a binder consisting of an inorganic compound such as boric acid or an organic polymeric compound such as a water-soluble resin, and is applied in the form of an aqueous liquid to the inside or outside surface of the die by way of, for example, spraying.

As regards the working environment, the nongraphite-type lubricant is preferable over the black graphite-type lubricant, and thus has recently been widely studied. However, the nongraphite-type lubricant is inferior to the graphite-type lubricant with respect to the lubricity. Therefore, the graphite-type lubricant is still widely employed for various uses.

Nevertheless, the graphite type lubricant has a disadvantageous in that since the graphite-type lubricant comprises graphite as an essential component that causes the resultant lubricant to exhibit an excellent lubricating effect, the occurrence of an undesirable carburizing phenomenon on the worked metal material is unavoidable due to the graphite.

This carburizing phenomenon greatly affects the worked metal material, especially when the metal material has a high upper limit of solid solubility of carbon at hot working temperatures, for example, a high alloy steel material is hot worked in the austenite state thereof. Namely, the carburizing phenomenon sometimes promotes undesirable hardening or cracking of the metal material, and thus can promote poor results in the subsequent forming process or can promote lowered product durability.

In response to the above-mentioned problem, new types of lubricants free from graphite are disclosed in JP-A-61-223,096 and JP-A-64-16,894. Nevertheless, a nongraphite-type lubricant comparable in lubricity to a graphite-type lubricant has not yet been developed.

SUMMARY OF THE INVENTION

An object of the present invention is to provide a graphite type lubricant composition for hot plastic working that is capable of inhibiting a carburizing phenomenon on a metal material lubricated therewith, although it contains graphite.

The above-mentioned object can be attained by the lubricant composition of the present invention for hot plastic working, which comprises 100 parts by weight of graphite particles and 2 to 100 parts by weight of particles of at least one metal oxide selected from the group consisting of tin oxides, lead oxides, zinc oxide, calcium oxide, copper oxides and aluminum oxide and having an average particle size of 0.01 to 20.0 μm.

DESCRIPTION OF THE PREFERRED EMBODIMENTS

In consideration of the above-mentioned prior arts, the inventors of the present invention intended to develop a new graphite-type lubricant composition capable of inhibiting an undesirable carburizing phenomenon, although it comprises graphite as an essential component, in accordance with an idea different from the prior arts. For this, the inventors studied in detail a reaction mechanism, a resultant gas atmosphere, and the combustion behavior of graphite, when a steel plate was coated with a graphite-type lubricant and heated at a high temperature of from about 700° C. to about 1100° C. As a result, it was found that the carburizing phenomenon could be effectively inhibited without hindering the lubricity of graphite by employing particles of at least one metal oxide selected from tin oxides, lead oxides, zinc oxide, calcium oxide, copper oxides and aluminum oxide and having an average particle size of from 0.01 to 20.0 μm, together with graphite particles.

The graphite particles usable for the lubricant composition of the present invention can be selected from natural and synthetic graphite particles. Although the average particle size of the graphite is variable depending on the form and the size of the metal material to be hot worked, the hot working temperature and the magnitude of working deformation, and the average size of the graphite particles is preferably 100 82 m or less, more preferably 0.5 to 30 μm . For example, when the working temperature is high and the working deformation is large, it is preferable that graphite particles having a relatively large average size be used to retain a good lubrication effect in the lubricant composition over a long period of time and to obtain good results.

In the lubricant composition of the present invention, it is essential that it contains, as an indispensable component, particles of at least one metal oxide selected from oxides of tin (Sn), lead (Pb), zinc (Zn), calcium (Ca), copper (Cu) and aluminum (Al), and having an average particle size of from 0.01 to 20.0 μm. The size of the individual particles is represented by an average of the lengths of the major axis and the minor axis thereof.

The lubricating mechanism of the metal oxide particles in the lubricant composition of the present invention has not yet been completely clarified. However, it is assumed that when a metal material to be worked and a die are heated at a high temperature and brought into contact with each other under pressure, a carbon monoxide (CO) gas is produced in a layer of the lubricant on the surface of the die, the metal oxide particles in the lubricant are locally reduced by the CO gas so as to produce a melt of the corresponding metal, the hot worked metal material surface is adhered to and coated by the metal melt, and the resultant metal element melt layer derived from the metal oxide particles and formed on the metal material surface serves as a barrier layer against the carburizing phenomenon to the hot worked metal material.

Also, the metal melt layer effectively holds the graphite particles therein and thus enhances the durability of the lubrication effect of the graphite particles.

If the average size of the metal oxide particles is less than 0.01 μm, the resultant metal oxide particles in the lubricant layer formed on the die surface vaporize easily or escape when the CO gas is generated in the lubricant layer at a high temperature.

Also, if the average size of the metal oxide particles is more than 20.0 μm, the formation of the reduced metal element melt layer becomes difficult, and thus the carburizing phenomenon-inhibiting effect and also the lubricity of the lubricant composition are reduced.

In the case that aluminum oxide (alumina) particles are used for the lubricant composition of the present invention, the preferable average size of the aluminum oxide particles is 0.01 to 2.0 μm.

In the lubricant composition of the present invention, the specific weight mixing ratio of the metal oxide particles to the graphite particles is 2:100 to 100:100. One of the reasons for which the amount of metal oxide particles is set forth based on the weight of the graphite particles, resides in the fact that the amount of metal oxide particles necessary for inhibiting the carburizing phenomenon is substantially and directly proportional to the amount of graphite particles contained in the lubricant composition.

When the amount of metal oxide particles is less than 2 parts by weight per 100 parts by weight of graphite particles, the resultant lubricant layer exhibits an unsatisfactory carburizing phenomenon-inhibiting effect and an insufficient lubricity-retaining effect. Also, if the amount of metal oxide particles is more than 100 parts by weight per 100 parts by weight of graphite particles, the lubrication effect of the graphite particles is sometimes obstructed by the metal oxide particles.

The particle size and the amount of metal oxide particles to be contained in the lubricant composition of the present invention should be appropriately set forth in consideration of the size of the graphite particles, the necessary thickness of the lubricant layer, the working temperature, etc. Generally, the ratio of the average particle size of the metal oxide particles to the graphite particle is preferably in the range of about 1:1 to about 1/100:1.

In the setting forth of the average size of the metal oxide particles, when the metal oxide has a low reduction tendency and a high oxidation tendency as those of, for example, calcium oxide, the metal oxide particles preferably have a relatively small average size.

However, when the metal oxide exhibits a high reduction tendency and a relatively low melting point, as those of, for example, tin (Sn) oxides, the metal oxide particles preferably have a relatively large average size.

When the metal material to be hot worked is easily carburized, the metal oxide particles are preferably contained in a relatively high proportion in the lubricant composition.

When only the carburizing phenomenon-inhibiting effect is considered, this effect will be satisfactory when the proportion of the metal oxide particles in the lubricant is large enough to cause the lubricant layer having a thickness of from 0.1 to 1.0 μm to remain on the metal material surface in the subsequent forming step.

When the metal oxide particles contained in the lubricant composition of the present invention are alumina particles having an average size of about 1 μm, the alumina particles are preferably in the form of a dry powder, and when the alumina particles have an average size of about 0.1 μm or less, they are preferably in the form of an aqueous colloidal aluminum dispersion.

The lubricant composition of the present invention for hot plastic working is preferably employed in the form of an aqueous dispersion, in view of the operating efficiency thereof, and when the aqueous dispersion of the lubricant composition is employed, the concentration of solid components therein is greatly variable in response to the hot plastic working conditions, the capacity of the lubricant-applying apparatus for the metal material to be worked, the die temperature and/or the production capacity of the hot working equipment. Usually, the lubricant composition of the present invention is diluted with water to an extent such that a total dry concentration of the lubricant components in the resultant aqueous dispersion reaches a level of 0.1 to 60% by weight.

Generally, the degree of dilution of the lubricant composition is set forth to such an extent that when the prevention of a temperature-increase of a die resulting from the metal material being heated at a high temperature, especially in a continuous mass production process, the lubricant composition is preferably highly diluted with water, and when the metal material to be hot-worked is large and has a complex form, the lubricant composition is diluted with small amounts of water in consideration of the lubrication effect.

The thickness of a dry lubricant layer is variable depending upon various conditions as mentioned above, and is preferably in the range of from 2 to 30 μm and when the lubricant is applied too thin, the resultant lubricant layer exhibits an unsatisfactory lubricating effect. Also, when the lubricant is applied too thick, resultant lubricant layer exhibits a saturated lubricating effect and a lowered economical efficiency.

The lubricant layer remaining on the resultant hot-worked metal material can easily be removed during an oxide film-removing step applied to the hot worked metal material. However, even if the lubricant layer is retained on the hot worked metal material, the appearance and the mechanical properties of the product is not affected by the remaining lubricant.

The lubricant composition of the present invention for hot plastic working optionally contains known additives, for example, binders, thickeners, antiseptics, and surfactants, which are added beforehand or at a final stage of the preparation of an aqueous lubricant composition dispersion, at which time, the solid concentration of the aqueous dispersion is adjusted to a desired value, before use thereof.

The binder for the lubricant composition comprises at least one member selected from the group consisting of inorganic compounds such as boric acid, boron oxide, and sodium chloride; proteins, for example, gelatin; and organic polymeric compounds such as carboxymethyl cellulose, starch, polysaccharide, sodium polycarbonate, polyvinyl alcohol-acrylic acid resins, polyvinyl acetate resins and phenol-formaldehyde resins.

Usually, the binder is contained in an amount of about 1 to 50% based on the total weight of the graphite particles and the metal oxide particles, and when too little binder is used, the binder cannot exhibit a satisfactory bonding effect. Also, if too much binder is employed, the lubricating effect of the graphite and the metal oxide particles are obstructed by the binder.

The surfactant is employed for the purpose of enhancing the dispersing property of the graphite and metal oxide particles in the aqueous dispersion. Some of the above-mentioned binders have the dispersing property-enhancing effect. However, when the surfactant is added, the dispersing property of the graphite and metal oxide particles can be further improved. The surfactant is preferably selected from the group consisting of, for example, polyoxyethylenealkylethers, polyoxyethylene-fatty acid esters, higher alcohol-sulfuric acid esters and sodium linoleate.

The surfactant is preferably used in an amount of 0.2 to 5.0% based on the total weight of the graphite and the metal oxide particles.

The thickeners are preferably selected from sodium carboxymethylcellulose, sodium silicate and sodium polyacrylate.

The antiseptics are preferably selected from sodium benzoate, potassium sorbate, triazin, thiadiazine, and sodium dehydroacetate.

EXAMPLES

The present invention will be further explained using the following examples.

Examples 1 to 5 and Comparative Examples 1 to 4

In each of Examples 1 to 5 and Comparative Examples 1 to 4, a lubricant composition was prepared by mixing 100 parts by weight of graphite particles having an average size of 4 μm with alumina particles having an average size as indicated in Table 1 in an amount as indicated in Table 1, and a binder consisting of carboxymethyl cellulose in an amount of 10% based on the total weight of the graphite particles and the alumina particles.

The resultant lubricant composition was subjected to a friction coefficient measurement test and a carburizing test (measurement of carbon amount under the surface of a steel material)

(1) Friction coefficient

An annular test piece having an outside diameter of 30 mm, an inside diameter of 15 mm and a thickness of 7.5 mm was prepared from an SUS304 stainless steel plate (steel composition: C: 0.06%, Cr: 18.5%, Ni: 8.7%).

The test piece was heated at a temperature of 1000° C. in an argon gas atmosphere.

Separately, a pair of upper and lower dies having smooth surfaces parallel to each other were heated at a temperature of 150° C. The lubricant composition as shown in Table 1 was diluted with water to provide a lubricant coating liquid in which the graphite particles were dispersed in an concentration of 20% by weight.

The lubricant coating liquid was applied to faces of the pair of dies with which the annular stainless steel test piece would be brought into contact, by a spraying method while stirring the lubricant coating liquid. The application of the lubricant coating liquid was controlled so as to form a lubricant composition layer having a dry film thickness of 10 μm.

The heated annular test piece was then placed on the faces of the dies on which the lubricant coating liquid was applied and subjected to a compression test under a pressure of 50 kg/mm$^2$.

The friction coefficient of the contact faces of the dies was determined from the height of the annular test piece and the change in the inside diameter thereof, using a conventional method (the energy method by Kudo).

(2) Carburizing test

The lubricant composition as shown in Table 1 was applied on a surface of a test piece consisting of an SUS stainless steel plate having a thickness of 1 mm and the same steel composition as mentioned above, to form a lubricant coating layer having a dry film thickness of 100 μm. The lubricant coated steel plate was dried at a temperature of 150° C., heated at a temperature of 1000° C. for one hour in a dry nitrogen gas stream, and then air cooled to room temperature.

The remaining lubricant coating layer on the test piece surface in an amount corresponding to about a half of the initial amount of the lubricant coating layer, was removed by water rinsing.

The test piece was subjected to a glow discharge spectroscopic analysis (GDS). In this analysis, the distribution of the concentrations of carbon (C), iron (Fe), nickel (Ni), aluminum (Al) and oxygen (O) in the layer have a depth of 5 μm from the uppermost surface of the test piece, while applying a sputtering operation to the surface.

The occurrence of the carburizing phenomenon in the test piece was examined by comparing the amount of carbon in a 5 μm surface layer of the lubricated test piece with that of the non-lubricated test piece.

The amount of carbon in the surface layer of the non-lubricated test piece was 0.05 to 0.06% by weight.

The test results are shown in Table 1.

TABLE 1

| | Item | | | | | | |
|---|---|---|---|---|---|---|---|
| | | | | | Lubrication result | | |
| | Alumina particles | | | | | Carburizing | |
| Example No. | Amount (part by wt.) | Particle size (μm) | Form | Graphite Amount (part by wt.) | Friction coefficient (μm) | Carbon content (% wt.) | Carburizing phenomenon |
| Comparative Example | | | | | | | |
| 1 | 0 | — | — | 100 | 0.15 | 0.17 | Yes |
| 2 | 1 | 0.05 | Colloidal | 100 | 0.15 | 0.15 | Yes |
| Example | | | | | | | |
| 1 | 20 | 0.05 | Colloidal | 100 | 0.13 | 0.06 | No |
| 2 | 40 | 0.05 | Colloidal | 100 | 0.12 | 0.06 | No |
| 3 | 40 | 0.2 | Powder | 100 | 0.10 | 0.06 | No |
| 4 | 40 | 1.0 | Powder | 100 | 0.13 | 0.06 | No |
| Comparative Example 3 | 40 | 25.0 | Powder | 100 | 0.17 | 0.12 | Yes (little) |

TABLE 1-continued

| Example No. | Item: Alumina particles: Amount (part by wt.) | Alumina particles: Particle size (μm) | Alumina particles: Form | Graphite Amount (part by wt.) | Lubrication result: Friction coefficient (μm) | Lubrication result: Carburizing: Carbon content (% wt.) | Lubrication result: Carburizing: Carburizing phenomenon |
|---|---|---|---|---|---|---|---|
| Example 5 | 80 | 0.2 | Powder | 100 | 0.14 | 0.06 | No |
| Comparative Example 4 | 160 | 0.05 | Colloidal | 100 | 0.21 | 0.06 | No |

Examples 6 to 14 and Comparative Examples 5 to 9

In each of Examples 6 to 14, a lubricant composition was prepared from the graphite particles as indicated in Table 2 and the metal oxide particles as shown in Table 2 in the composition as indicated in Table 2.

TABLE 2

| Example No. | Symbol of composition | Graphite particles: Average particle size (μm) | Graphite particles: Amount (part by wt.) | Metal oxide particles: Type | Metal oxide particles: Average particle size (μm) | Metal oxide particles: Amount (part by wt.) |
|---|---|---|---|---|---|---|
| Example | | | | | | |
| 6 | a | 4 | 100 | PbO | 12 | 40 |
| 7 | b | 4 | 100 | SnO | 4 | 30 |
| 8 | c | 4 | 100 | $SnO_2$ | 3 | 45 |
| 9 | d | 4 | 100 | ZnO | 0.4 | 30 |
| 10 | e | 4 | 100 | ZnO | 2 | 20 |
| 11 | f | 4 | 100 | ZnO | 2 | 50 |
| 12 | g | 4 | 100 | CuO | 6 | 30 |
| 13 | h | 4 | 100 | CaO | 13 | 30 |
| 14 | i | 4 | 100 | *1 | *1 | 30 |

Note:
*1 A mixture of SnO particles (average size: 4 μm) with ZnO particles (average size: 2 μm) in a mixing weight ratio of 50:50

In each of Comparative Examples 5 to 9, a lubricant composition was prepared from the graphite particles as indicated in Table 3 and the metal oxide particles as shown in Table 3 in the composition as indicated in Table 3.

TABLE 3

| Example No. | Symbol of composition | Graphite particles: Average particle size (μm) | Graphite particles: Amount (part by wt.) | Metal oxide particles: Type | Metal oxide particles: Average particle size (μm) | Metal oxide particles: Amount (part by wt.) |
|---|---|---|---|---|---|---|
| Comparative Example | | | | | | |
| 5 | j | 4 | 100 | None | — | — |
| 6 | k | 4 | 100 | SnO | 2 | 1 |
| 7 | l | 4 | 100 | SnO | 2 | 120 |
| 8 | m | 4 | 100 | CuO | 24 | 30 |
| 9 | n | 4 | 100 | CaO | 0.008 | 30 |

In each of Examples 6 to 14, the lubricant composition as indicated in Table 2 was mixed with the binder and the surfactant as indicated in Table 4 in the concentrations as shown in Table 4, to provide an aqueous lubricant dispersion.

TABLE 4

| Example No. | Lubricant composition (graphite/metal oxide): Symbol | Lubricant composition (graphite/metal oxide): Solid concentration (wt. %) | Binder: Carboxy-methyl cellulose (wt. %) | Binder: Water-soluble acrylic resin (*)2 (wt. %) | Surfactant: Polyoxyethylene alkylether (*)3 (wt. %) |
|---|---|---|---|---|---|
| Example | | | | | |
| 6 | a | 20 | 1.0 | 2.5 | 2 |
| 7 | b | 20 | 0.5 | 4.5 | 2 |
| 8 | c | 20 | 1.0 | 2.5 | 2 |
| 9 | d | 20 | 1.0 | 2.5 | 2 |
| 10 | e | 20 | — | 5.0 | 2 |
| 11 | f | 20 | 1.0 | 2.5 | 2 |

TABLE 4-continued

| Example No. | Lubricant composition (graphite/metal oxide) Symbol | Solid concentration (wt. %) | Binder: Carboxymethyl cellulose (wt. %) | Binder: Water-soluble acrylic resin (*)2 (wt. %) | Surfactant: Polyoxyethylene alkylether (*)3 (wt. %) |
|---|---|---|---|---|---|
| 12 | g | 20 | 0.5 | 4.5 | 2 |
| 13 | h | 20 | 1.0 | 2.5 | 2 |
| 14 | i | 20 | — | 5.0 | 2 |

Note:
(*)2 Trademark: ARON-81, made by TOAGOSEI CHEMICAL INDUSTRY CO., LTD
(*)3 Trademark: PASOFUTO, made by NIPPON OIL & FATS CO., LTD.

In each of Comparative Examples 5 to 9, the lubricant composition (graphite/metal oxide) as indicated in Table 3 was mixed with the binder and surfactant as indicated in Table 5 in the concentrations as indicated in Table 5, to provide an aqueous lubricant dispersion.

TABLE 5

| Comparative Example No. | Lubricant composition (graphite/metal oxide) Symbol | Solid concentration (wt. %) | Binder: Carboxymethyl cellulose (wt. %) | Binder: Water-soluble acrylic resin (*)2 (wt. %) | Surfactant: Polyoxyethylene alkylether (*)3 (wt. %) |
|---|---|---|---|---|---|
| Comparative Example | | | | | |
| 5 | j | 20 | 1.0 | 2.5 | 2 |
| 6 | k | 20 | 1.0 | 2.5 | 2 |
| 7 | l | 20 | 1.0 | 2.5 | 2 |
| 8 | m | 20 | 1.0 | 2.5 | 2 |
| 9 | n | 20 | — | 5.0 | 2 |

In the preparation of each aqueous lubricant dispersion, the binder and surfactants in the above-mentioned amounts were dissolved in a small amount of water so as to provide a concentrated aqueous solution. The concentrated aqueous solution was mixed with the lubricant composition in the above-mentioned amount while stirring. The mixture was diluted with water to provide an aqueous lubricant dispersion having the above-mentioned concentration.

In each of Examples 6 to 14 and Comparative Examples 5 to 9, the resultant aqueous lubricant dispersion was subjected to the same friction coefficient measurement and carburizing tests as mentioned above.
The test results are shown in Table 6.

TABLE 6

| Example No. | Item: Performance of lubricant composition: Friction coefficient | Carburizing: Carbon content (wt. %) | Carburizing: Carburizing phenomenon |
|---|---|---|---|
| Example | | | |
| 6 | 0.15 | 0.06 | No |
| 7 | 0.13 | 0.06 | No |
| 8 | 0.15 | 0.06 | No |
| 9 | 0.13 | 0.06 | No |
| 10 | 0.13 | 0.06 | No |
| 11 | 0.14 | 0.06 | No |
| 12 | 0.14 | 0.06 | No |
| 13 | 0.10 | 0.06 | No |
| 14 | 0.12 | 0.06 | No |
| Comparative Example | | | |
| 5 | 0.15 | 0.17 | Yes |
| 6 | 0.14 | 0.13 | Yes |

TABLE 6-continued

| Example No. | Item: Performance of lubricant composition: Carburizing: Carbon content (wt. %) | Carburizing phenomenon |
|---|---|---|
| 7 | 0.20 (*)4 | 0.06 | No |
| 8 | 0.14 | 0.17 | Yes |
| 9 | 0.16 | 0.11 | Yes (little) |

Note:
(*)4 Too high

Tables 1 to 6 clearly show that the lubricant compositions of the present inventions (Examples 1 to 14) do not hinder the lubricating effect of the graphite contained therein. Also, they exhibit an enhanced lubricity compared with that of conventional graphite type lubricants and effectively prevent or reduce the undesirable carburizing phenomenon.

Accordingly, the lubricant composition of the present invention for hot plastic working of metal materials can prevent or reduce the carburizing phenomenon without hindering the high lubricity of the graphite and contribute to the enhancement of dimensional accuracy, surface appearance, and mechanical properties of products used in industrial fields in which a metal material is subjected to a warm or hot plastic working thereby raising the productivity thereof.

We claim:

1. A lubricant composition for hot plastic working of metal material comprising 100 parts by weight of graphite particles and 2 to 100 parts by weight of particles of at least one metal oxide selected from the group consisting of tin oxides, calcium oxide, copper oxides and aluminum oxide, and having an average particle size of 0.01 to 20.0 μm.

2. The lubricant composition as claimed in claim 1, wherein the graphite particles have an average size of 100 μm or less.

3. The lubricant composition as claimed in claim 1, wherein the aluminum oxide particles have an average size of 0.01 to 2.0 μm.

4. The lubricant composition as claimed in claim 1, wherein the metal oxide particles have an average size ratio to the graphite particles of 1:1 to 1/100:1.

5. The lubricant composition as claimed in claim 1, further comprising at least one additive selected from the group consisting of binders, thickeners, antiseptics and surfactants.

6. The lubricant composition as claimed in claim 5, wherein the binder comprises at least one member selected from the group consisting of boric acid, boron oxide, sodium chloride, proteins, carboxymethyl cellulose, starch polysaccharide, sodium polycarbonate, polyvinyl alcohol-acrylic acid resins, polyvinyl acetate resins, and phenol-formaldehyde resins.

7. The lubricant composition as claimed in claim 5, wherein the binder is present in an amount of 1 to 50% based on the total weight of the graphite particles and the metal oxide particles.

8. The lubricant composition as claimed in claim 5, wherein the surfactant comprises at least one member selected from the group consisting of polyoxyethylenealkylethers, polyoxyethylene-fatty acid esters, higher alcohol-sulfuric acid esters, and sodium linoleate.

* * * * *